United States Patent [19]

Köbler et al.

[11] 4,434,979

[45] Mar. 6, 1984

[54] PRINTED GOODS REMOVAL APPARATUS

[75] Inventors: Ingo Köbler, Anhausen; Hans-Jürgen Mische, Augsburg, both of Fed. Rep. of Germany

[73] Assignee: M.A.N.-Roland Druckmaschinen Aktiengesellschaft, Augsburg, Fed. Rep. of Germany

[21] Appl. No.: 353,234

[22] Filed: Mar. 1, 1982

[30] Foreign Application Priority Data

Mar. 7, 1981 [DE] Fed. Rep. of Germany ..... 3108681

[51] Int. Cl.[3] ..... B65H 29/00

[52] U.S. Cl. ..... 271/307; 271/82; 271/187; 271/244; 271/315

[58] Field of Search ..... 271/230, 244, 270, 275, 271/277, 307, 178, 187, 315, 82

[56] References Cited

U.S. PATENT DOCUMENTS

| | | | |
|---|---|---|---|
| 2,172,364 | 9/1939 | DeManna | 271/315 |
| 4,205,837 | 6/1980 | von Hein | 271/315 X |
| 4,357,126 | 11/1982 | Kidd | 271/315 X |

*Primary Examiner*—Richard A. Schacher

*Attorney, Agent, or Firm*—Frishauf, Holtz, Goodman & Woodward

[57] ABSTRACT

Printed goods (8,8'') are aligned and positioned in predetermined staggered or shingled or imbricated arrangement on a transport conveyor (7,15) by placing, between distribution wheels (1,1') located axially spaced on a shaft (2,2'), a group of abutment wheels (4,4') which rotate with the distribution wheels but at a slower speed, for example by having an internal gearing matching a gear wheel (5) located on the shaft (2), the abutment wheels (4,4') being eccentrically positioned with respect to the shaft (2) by being guided in their movement by a disc (3,3') eccentrically positioned with respect to the shaft (2), and held in position by a suitable bracket or the like. These discs (3,3') form cams. The abutment wheels (4,4') are formed with abutment surfaces (6,6',6'') against which the printed goods will impinge, to provide for alignment of the front edges and, due to the slower speed of rotation of the abutment wheels, the goods (8'') will be pushed out from between adjacent vanes upon continued rotation of both the distribution wheels (1) and the abutment wheels (4). The stagger spacing (x) between adjacent printed elements (8,8',8'') will be determined by the spacing between abutments and, if conveyor (7) moves at the same circumferential speed as the abutment wheel, the spacing thereon will be maintained. Grippers (13) can be located to cooperate with the abutments to clamp the leading edge of the printed goods for transport from the distribution wheels independently of gravity, for example to gripper spring (14) of the conveyor chain (15).

11 Claims, 4 Drawing Figures

PRINTED GOODS REMOVAL APPARATUS

The present invention relates to an apparatus adapted to be associated with a printing machine and a folding apparatus, and more particularly to the arrangement to remove printed, folded goods from a folder, which includes a distribution wheel having separating blades or vanes thereon.

BACKGROUND

Various types of removal apparatus have been proposed. German Patent Disclosure Document DE-OS 28 11 467 (to which U.S. Pat. No. 4,205,837, Von Hein & Rothen, corresponds), describes an apparatus to deliver printed goods in form of a stream or train of overlapped, imbricated, folded individual elements, for example in a fish-scale or shingled arrangement. This apparatus, essentially, includes a chain having grippers thereon. The chain is guided between two disks of a distribution wheel of a folding apparatus. The printed elements are removed forcibly from the distribution wheel and transferred to a conveyor belt located therebeneath in overlapped position, with predetermined distances of the edges. It is difficult to handle the printed goods gently since they are removed by grippers on the chains; it is also difficult to maintain the stagger distance between the individual printed elements, since the grippers must remove the printed subject matter from rotating vanes or blades of the distribution disks. If the printed subject matter is to be placed on a continuously moving transport device, for example a conveyor belt, by forming a staggered, overlapping train of goods, it is practically impossible to maintain the desired distance between individual printed elements due to uncontrolled sliding movement from the spaces between the distribution vanes.

THE INVENTION

It is an object to improve the apparatus permitting removal of folded, printed subject matter which handles the printed subject matter gently, while permitting exact positioning thereof at predetermined staggered distances, in overlapped or imbricated relation, on a transport device.

Briefly, an abutment wheel is provided which has a number of abutments matching the number of distribution vanes or blades of the distribution wheel. The abutment wheel is eccentrically located with respect to the axis of rotation of the distribution wheel, and rotates at a lower speed than the distribution wheel. The distribution wheel and the abutment wheel are so located with respect to each other that a printed element is introduced between adjacent curved distribution blades or vanes and meets the abutment of the abutment wheel which, upon continued rotation, will later on push out the printed subject matter from between adjacent vanes or blades of the distribution wheel to remove the printed subject matter therefrom and place it on a transport element, for example a conveyor belt, with uniform accurately defined, staggered distances between sequential printed elements.

DRAWINGS

Figure 1:
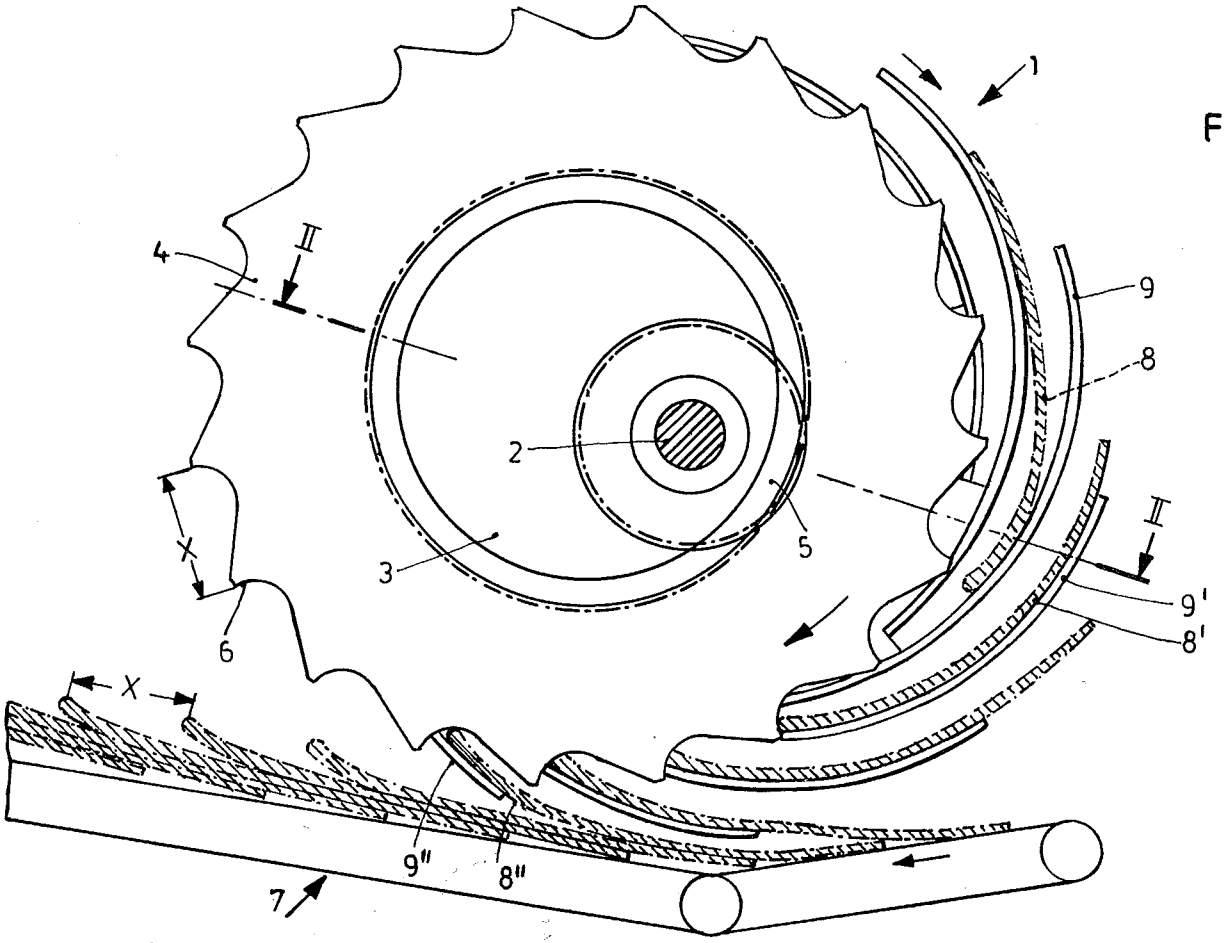
FIG. 1 is a highly schematic side view of the apparatus to remove printed goods from a printing machine, for example a folder (not shown)

A group of distribution wheels 1, 1' have distribution vanes or blades circumferentially located thereon, as well known in the printed goods distribution field. Sometimes these wheels are also referred to as distribution paddle wheels. The distribution wheels 1,1 are spaced axially from each other and secured to a shaft 2. A fixed disc 3,3' is secured in position surrounding the shaft 2, but located eccentrically with respect therewith. Preferably, a plurality of such eccentric discs 3,3' are provided. Each one of the discs 3,3' have abutment wheels 4,4' located thereabout. The abutment wheels 4,4' are internally geared and in gearing, driving engagement with externally geared drive wheels 5. Thus, the abutment wheels 4 can be driven from the gears 5 with a predetermined transmission ratio. The abutment wheels 4,4' have abutments 6 located at the circumference therof. The abutments 6 are shaped in tooth-form, spaced from each other by a (FIGS. 1 and 3) desired spacing x, which corresponds to the staggering, or overlap or shingling spacement of the goods upon delivery.

A conveyor 7 is located beneath the distribution wheels 1,1' on which the printed goods 8 are deposited with the predetermined stagger spacing x.

Operation: The printed goods which are introduced in the space between vanes or blades 9 are aligned by the abutments 6 due to the eccentric positioning of the abutment wheels 4,4' and the smaller circumferential speed of the abutments 6, with respect to the circumferential speed of the vanes or blades 9. As the abutment wheels rotate, and continue to lag behind, in rotation, the distribution wheels, the printed goods 8 are pushed out by the abutments 6 of the abutment wheels 4,4' when the printed goods 8 are moved to the lower region of the distribution wheels 1,1'. Thus, the printed goods 8 are pushed out from the space between the vanes or blades 9 and are positioned with predetermined stagger or spacing x on the conveyor 7, which, for example, may be a conveyor belt. The operating speed of the conveyor 7 is selected to be the same as the circumferential speed of the abutments 6. Thus, when the printed goods 8 are removed by the conveyor 7, the predetermined stagger or shingling distance x determined by the abutment wheels 4,4' is maintained.

Figure 2:
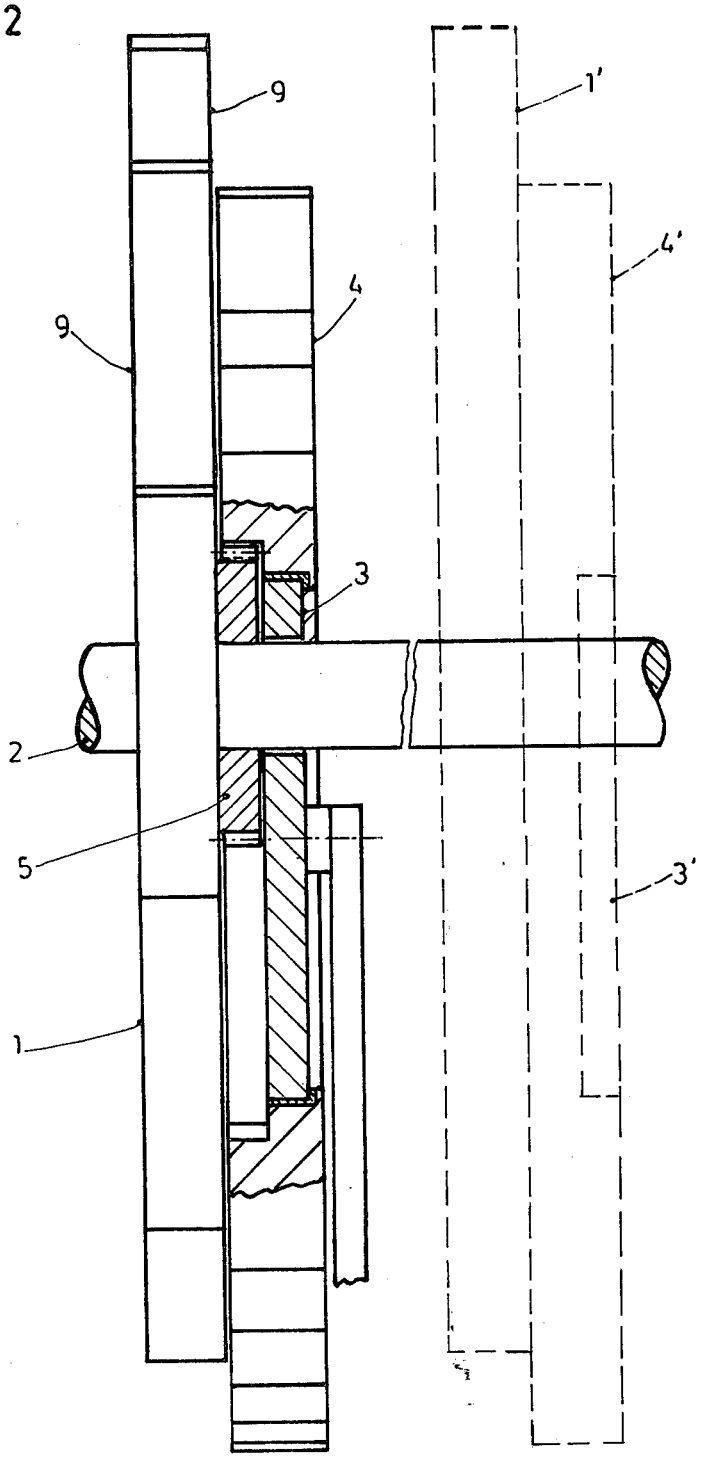
FIG. 2 is a front view of the arrangement of FIG. 1.

The direction of rotation of the distribution wheels 1,1', of the abutment wheels 4,4', and the direction of movement of the transport conveyor 7 are all indicated by arrows in FIGS. 1 and 2.

The disc 3 forms a cam. It is eccentrically so located, and the relative speeds are so selected, that the sequence of positioning of printed goods will be (referring to FIG. 1): printed element **8*a* is introduced between vanes or blades 9,9*a*. Upon continued rotation, the printed element 8 will reach the position shown at 8' between the vanes 9,9' and located in alignment and positioning by the abutment 6' of the abutment wheel 4. Locating a plurality of such abutment wheels axially along shaft 2 provides for gentle, yet effective precise transverse alignment of the element 8,8'. The difference in circumferential speed between the wheel 1,1' and the wheel 4,4'** is small so that alignment is gentle.

Continued rotation of the wheels 1,1' and 4,4' will result in gentle removal of the goods from the spaces between the vanes or blades, as seen in the lower region of FIG. 1, for a subsequent deposition of the goods 8 on the transport conveyor. Transfer of the goods 8 to the conveyor 7 also is gentle since, as noted above, the transport speed of the conveyor 7 is selected to be the same as the circumferential speed of the abutment wheels 4,4'. FIG. 1 illustrates, sequentially, the position of 3 printed elements 8,8',8'' in different positions. The element 8, which is uppermost between the vanes 9a,9 has been preceded by an element 8' which is positioned between the vanes 9,9', and aligned by the abutment 6'. Removal is illustrated with respect to an element 8''. The vane 9'' is removed upwardly, the element 8'' sliding with respect to the vane or blade 9'' and being positively, but gently removed by the abutment 6'' which, as noted above, rotates at a lesser speed than the speed of the distribution wheel 1 carrying the vane 9''. Thus, the printed element 8'' is positioned on the conveyor 7, the predetermined distance x being maintained as being shown in FIG. 1.

Figure 3:
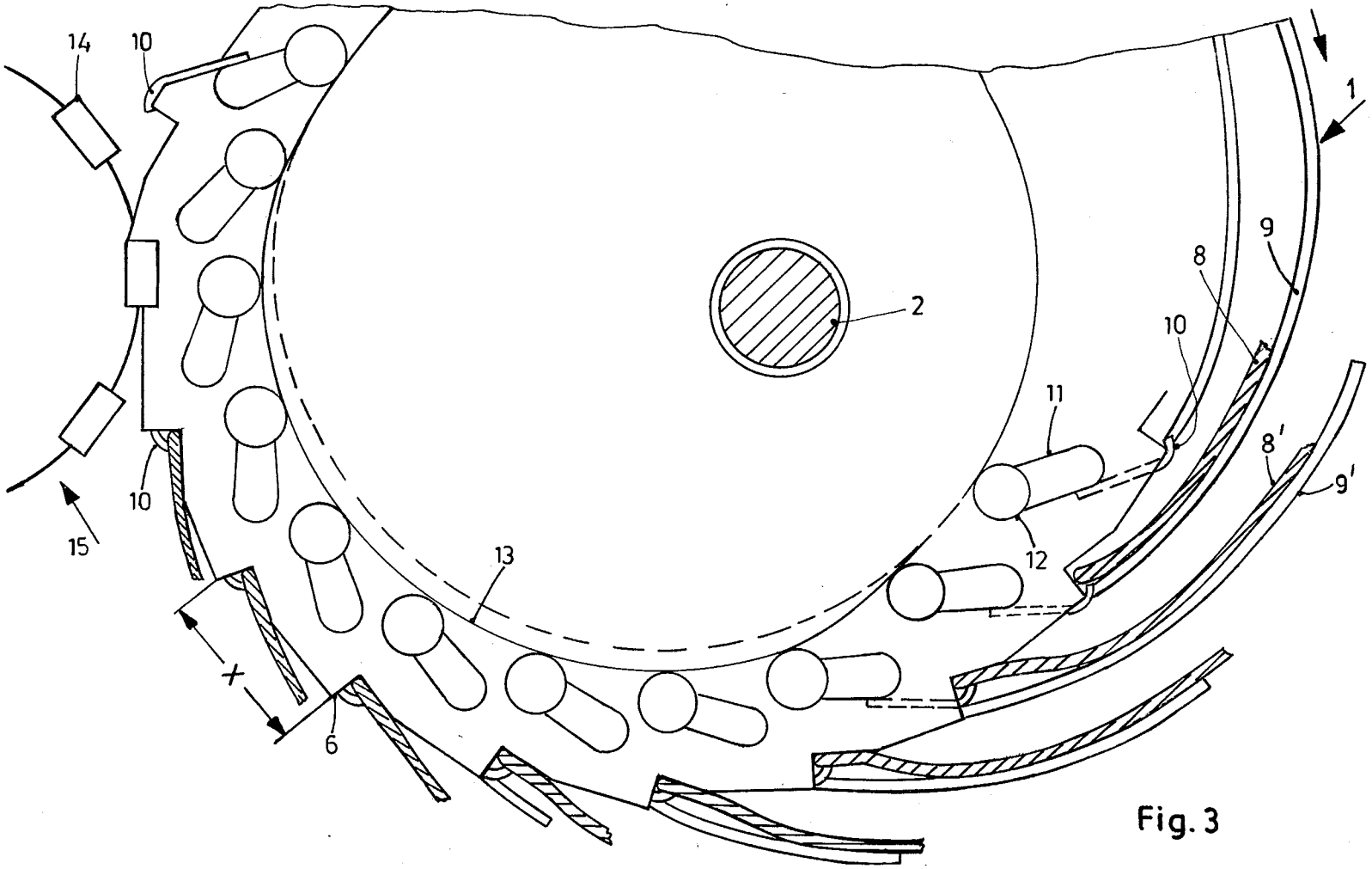
FIG. 3 is a schematic side view of another embodiment.
Figure 4:
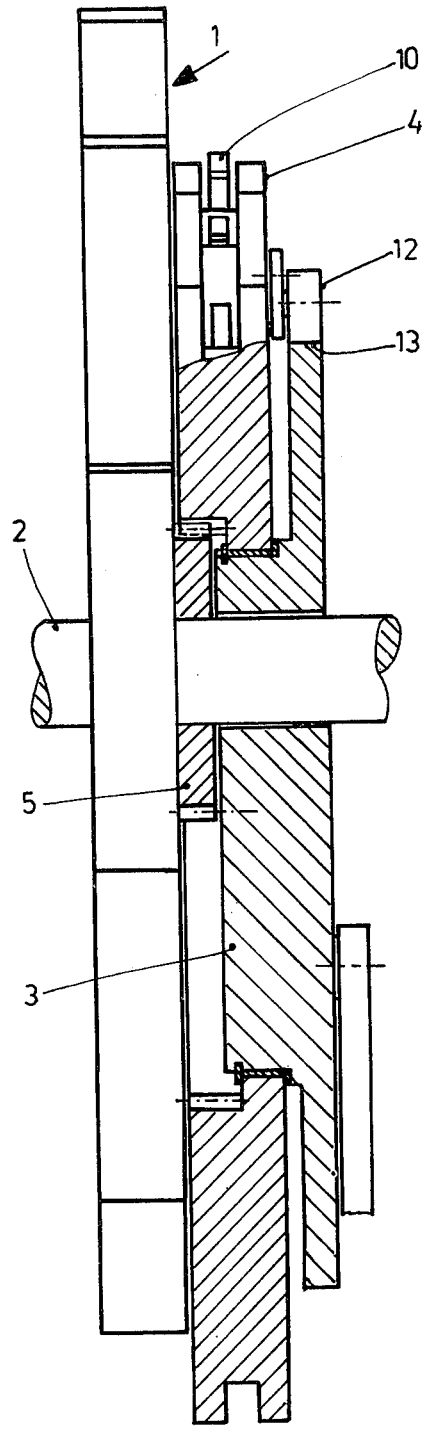
FIG. 4 is a front view of the apparatus of FIG. 3.

The embodiment of FIGS. 3 and 4: basically the structure is similar to that shown in FIG. 1. The wheel 4, in the region of the abutments 6 has grippers 10 placed thereon, additional to the abutment shown in FIGS. 1 and 2. The grippers 10 are controlled by control lever 11. The roller 12 thereof is controlled in position by engagement with a fixed control cam 13. As best seen in FIG. 4, the control cam can be formed by suitable construction of a disc 3'.

Operation: When the leading edge of the printed element 8 has reached the abutment 6, the gripper 10 is moved inwardly by pivoting on the control lever 11, thus clamping the goods in position. The goods are held, clamped, upon continued rotation of the distribution wheel 1 until they are to be transferred to a transport device 15 which is formed with grippers 14, shown only schematically, and which may be of any well known suitable and standard construction. The transport device 15 may, for example, be a transport chain and need not be positioned below or beneath the distribution wheel 1. Thus, transfer can be carried out independently of gravity. Transfer of the printed element 8'' from out between the vanes will occur upon continued relative rotation of the distribution wheel 1 and the abutment wheel 4. Due to the grippers, the printed element 8,8' need not be retained in the space between adjacent vanes or blades for their entire, or at least a substantial portion of their travel with the distribution wheel 1,1'. Thus, the element 8'' can be transferred to the grippers 14 of the tranport device in gentle manner, at the predetermined stagger distance x by transfer to the grippers 14. Grippers 14 of the transport device no longer must reach into or between the vanes or blades of the distribution wheel 1 in order to remove the printed element 8,8'', respectively, therefrom. Rather, the eccentric position determined by the disc 3, which also forms the cam 13, permits individual transfer to gripper-operated transfer elements.

The printed elements 8 are clamped by the grippers 10 and thus the transport device 15 can readily be placed laterally of the distribution wheel 1.

The relative speed differences between the distribution wheel 1 and the abutment wheel 4 can readily be calculated by considering the structural requirements, for example, spacing of the abutments 6, and the introduction position with respect to the delivery positions, as seen, for example, in FIGS. 1 and 3, respectively. The disc 3 can be held in position by a suitable bracket, secured for example to the frame of the apparatus (not shown) and merely schematically indicated in FIGS. 2 at 3a. The various wheels can be held in position on the shaft 2, and with respect to each other by suitably located holding rings, for example C-rings or the like, as well known in the positioning of rotary structures.

Various changes and modifications may be made within the scope of the inventive concept.

We claim:

1. Printed goods removal and staggered, imbricated distribution apparatus having at least one distribution wheel (1, 1') having circumferentially located distribution vanes or blades (9, 9', 9'', 9a) between which printed goods (8) to be distributed are inserted, and a rotating shaft (2) to which said at least one distribution wheel (1, 1') is secured, and comprising, in accordance with the invention, at least one disc (3) secured in fixed position and located eccentrically with respect to the shaft (2) of the distribution wheel to permit rotation of the shaft, and hence of the distribution wheel with respect to at least one disc;

an abutment wheel (4) rotatable about the fixed disc (3) and having abutment surfaces (6, 6', 6'') on a circumference thereof uniformly spaced from each other by a predetermined distance (x);

means (5) rotating the abutment wheel (4) in the same direction as the distribution wheel (1, 1') and at a speed which is slower than the speed of the distribution wheel; and removal means (7, 15) operating at a linear speed corresponding to the circumferential speed of the abutments (6) of the abutment wheel (4);

the eccentric position of the disc (3) being adjusted with respect to the distribution wheel such that printed goods (8) introduced in the space between said vanes or blades first engage an abutment (6) of the abutment wheel (4) and then, upon continued rotation of the distribution wheel, as well as continued rotation of the abutment wheel at said slower speed, the abutment wheel will push the printed goods (8'') out from between said space at the predetermined distance (x) from preceding printed goods (8, 8') in a preceding space for imbricated removal on the removal means with said predetermined spacing (x).

2. Apparatus according to claim 1, further including a continuously operating conveyor means located beneath the distribution wheel having a speed of conveyance which is matched to the circumferential speed of the abutment (6) of the abutment wheel so that printed elements (8) will form a staggered or shingled stream of printed goods, in which the elements are spaced from each other by said predetermined distance (x) with which they are removed from the distribution wheel by said abutment wheel.

3. Apparatus according to claim 1, wherein said rotating means comprises a gear (5) secured on the shaft (2) driving the distribution wheel and in gearing engagement with the abutment wheel (4) with the predetermined transmission wheel to drive said abutment wheel at the slower speed.

4. Apparatus according to claim 3, wherein the abutment wheel (4) carries an internal gear and the gear (5) has an outer gearing, in meshing engagement with the internal gear of the abutment wheel (4).

5. Apparatus according to claim 1, wherein the removal means comprises a conveyor belt, receiving elements of the printed goods as they are removed from between the spaces of succeeding vanes or blades of the distribution wheel.

6. Apparatus according to claim 1, wherein a plurality of distribution wheels (1,1') are provided;

and each distribution wheel has an abutment wheel (4,4') associated therewith, the distribution wheels and abutment wheels being axially spaced along said shaft, and the abutments (6) providing for edge-alignment of printed goods upon engagement of a leading edge of a printed element (8') with axially staggered abutments (6') of the abutment wheels.

7. Apparatus according to claim 1, further including gripper elements (10) located adjacent the abutment surfaces (6);

and gripper control means (13) controlling operation of the grippers to clamp a printed element (8,8') upon engagement of a printed element with an abutment surface at the leading edge thereof.

8. Apparatus according to claim 7, wherein the gripper control means comprises roller levers (11) and a fixed control cam (13);

and cam follower means (12) connected to said roller lever and in engagement with said cam to control clamping, releasing movement of said grippers.

9. Apparatus according to claim 7, wherein the removal means comprises a transport means (15) having transport grippers (14), said transport grippers (14) receiving the printed goods (8,8'') from said grippers on the abutment wheel.

10. Apparatus according to claim 5, wherein a plurality of distribution wheels (1,1') are provided;

and each distribution wheel has an abutment wheel (4,4') associated therewith, the distribution wheels and abutment wheels being axially spaced along said shaft, and the abutments (6) providing for edge-alignment of printed goods upon engagement of a leading edge of a printed element (8') with axially staggered abutments (6') of the abutment wheels.

11. Apparatus according to claim 9, wherein a plurality of distribution wheels (1,1') are provided;

and each distribution wheel has an abutment wheel (4,4') associated therewith, the distribution wheels and abutment wheels being axially spaced along said shaft, and the abutments (6) providing for edge-alignment of printed goods upon engagement of a leading edge of a printed element (8') with axially staggered abutments (6') of the abutment wheels.

* * * * *